United States Patent [19]

Harbarger

[11] Patent Number: 4,819,387

[45] Date of Patent: Apr. 11, 1989

[54] METHOD OF SLICING SEMICONDUCTOR CRYSTAL

[75] Inventor: Josephine A. Harbarger, Phoenix, Ariz.

[73] Assignee: Motorola, Inc., Schaumburg, Ill.

[21] Appl. No.: 133,863

[22] Filed: Dec. 16, 1987

[51] Int. Cl.[4] ..... B24B 27/06

[52] U.S. Cl. ..... 51/283 R; 51/5 D; 51/325; 125/13 R

[58] Field of Search ..... 125/11, 12, 13 R, 14, 125/15; 51/5 D, 73 R, 216 LP, 216 R, 283 R, 325; 83/174, 174.1; 269/289 R, 296

[56] References Cited

U.S. PATENT DOCUMENTS

| | | | |
|---|---|---|---|
| 2,709,384 | 5/1955 | Harris | 269/296 X |
| 4,227,348 | 10/1980 | Demers | 125/13 R X |
| 4,228,782 | 10/1980 | Demers et al. | 125/14 |
| 4,420,909 | 12/1983 | Steere, Jr. | 125/13 R X |
| 4,465,268 | 8/1984 | Hudson | 269/296 X |
| 4,667,650 | 5/1987 | Girard et al. | 125/13 R |

FOREIGN PATENT DOCUMENTS

| | | | |
|---|---|---|---|
| 62743 | 5/1980 | Japan | 125/13 R |

*Primary Examiner*—Robert P. Olszewski

*Attorney, Agent, or Firm*—Charles R. Lewis; Raymond J. Warren

[57] ABSTRACT

A mounting beam is described having a V-shaped surface capable of having various sizes of semiconductor crystals mounted thereon. This mounting beam is comprised of either: a graphite material mixed with aluminum oxide or silicon carbide; or a graphite body having dressing sticks disposed therein. During the slicing process, when a slicing blade cuts through the crystal into the mounting beam, the blade will be dressed by the sticks or the mounting beam itself.

1 Claim, 2 Drawing Sheets

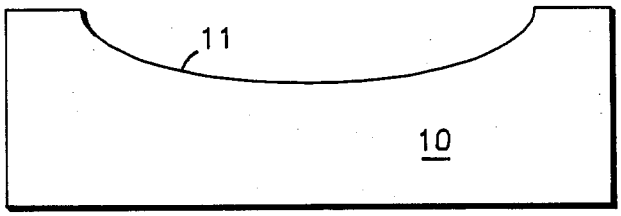
FIG. 1
-PRIOR ART-
FIG. 3
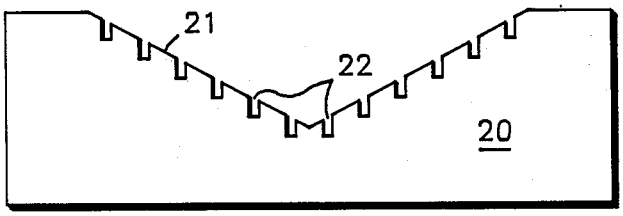
FIG. 2
-PRIOR ART-
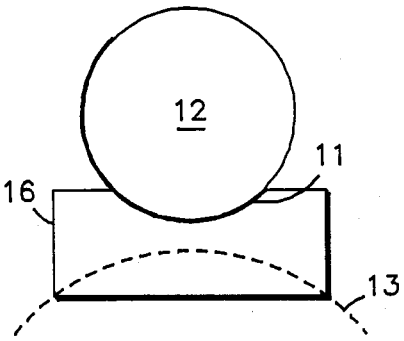
FIG. 4
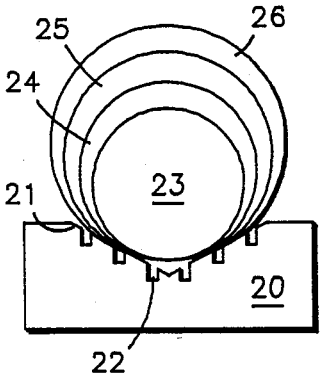

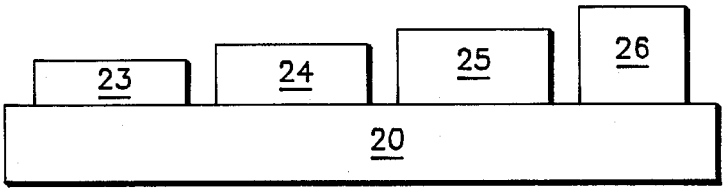
FIG. 5
FIG. 6
-PRIOR ART-
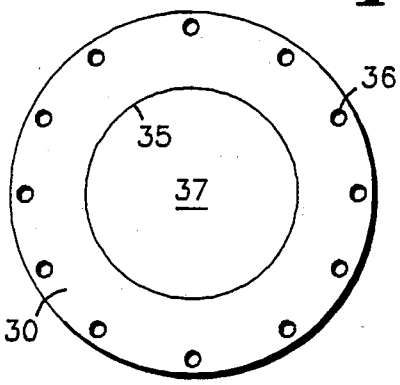
FIG. 8
-PRIOR ART-
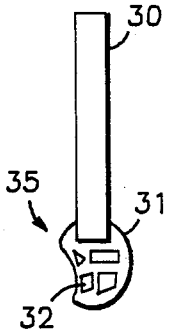
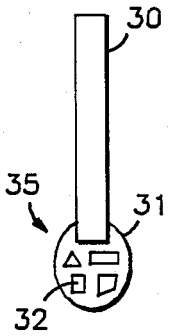
FIG. 7
-PRIOR ART-
FIG. 9
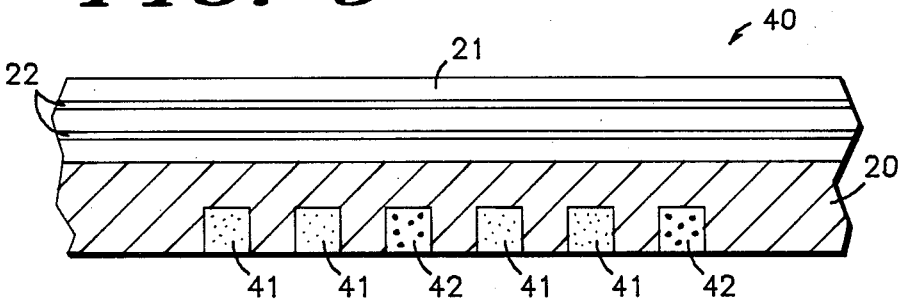

METHOD OF SLICING SEMICONDUCTOR CRYSTAL

BACKGROUND OF THE INVENTION

The present invention relates, in general, to semiconductor crystal mounting beams and, more particularly, to a universal semiconductor crystal mounting beam for use during slicing of the crystal.

Presently, when semiconductor crystals are to be sliced into wafers, the crystal is mounted on a mounting beam. The crystal is mounted using a glue to hold it in place. The current mounting beams are designed with a concave portion having a radius that matches the radius of the crystal being mounted. An existing problem with the present mounting beam is that each mounting beam is compatible with only one size crystal, whereas, crystals come in several diameters (e.g. 2, 3, 4, 5, and 8 inches). This requires that a plurality of different size mounting beams be maintained in stock. In addition, because of the mating surfaces of the beam and the crystal, air voids can be left in the glue used to secure the crystal to the beam. These voids result in chips in the crystal adjacent the voids when the crystal is sliced.

In the process of slicing the crystals into wafers, the cutting blades will become dull or off-centered. Due to this problem, periodically the crystal must be removed from the saw and the blade must be dressed. The process of dressing the blade consists of running the saw blade on a dressing stick. The dressing stick is of a material, aluminum oxide or silicon carbide, which is harder that the saw blade and will sharpen the blade. The dressing stick is then removed and the crystal reinserted for further slicing. This process is very time consuming and causes a processing bottleneck.

Accordingly, it is an object of the present invention to provide a semiconductor crystal mounting beam and method of slicing that overcomes the above deficiencies.

A further object of the present invention is to provide a semiconductor crystal mounting beam that is universal in the size of crystal that may be mounted.

Another object of the present invention is to provide a semiconductor crystal mounting beam and method of slicing that will reduce processing time.

Still another object of the present invention is to provide a semiconductor crystal mounting beam and method of slicing that will dress the saw blade during the slicing process.

Yet another object of the present invention is to provide a semiconductor crystal mounting beam and method of slicing that is more economic to use.

Another object of the present invention is to provide a semiconductor crystal mounting beam that will allow void free attachment of the crystal to the mounting beam.

The above and other objects and advantages of the present invention are provided by the semiconductor crystal mounting beam and method of slicing described herein.

SUMMARY OF THE INVENTION

A particular embodiment of the present invention consists of a semiconductor crystal mounting beam comprising an aluminum oxide material mixed with graphite such that during each slice of the semiconductor crystal, the saw blade will be micro-dressed.

A second particular embodiment of the present invention consists of a semiconductor crystal mounting beam having dressing sticks disposed therein at regular intervals such that as the dressing stick is contacted, the blade will be macro-dressed.

A third particular embodiment of the present invention consists of a semiconductor crystal mounting beam having a V-shape to allow mounting of various diameter semiconductor crystals. The beam further comprises a plurality of grooves running the length of the beam to permit the flow of glue into the grooves and prevent voids in the glue.

BRIEF DESCRIPTION OF THE DRAWINGS

FIG. 1 is an end view of a prior art mounting beam;

FIG. 2 is an end view of the mounting beam of FIG. 1 with a semiconductor crystal mounted thereon;

FIG. 3 is an end view of a mounting beam embodying the present invention;

FIG. 4 is an end view of the mounting beam of FIG. 3 with a plurality of semiconductor crystals mounted thereon;

FIG. 5 is a side view of the mounting beam and crystals of FIG. 4;

FIGS. 6–8 are views of a prior art inside diameter saw blade utilized in slicing semiconductor wafers; and FIG. 9 is a cross sectional view a second embodiment of the present invention.

DETAILED DESCRIPTION OF THE DRAWINGS

Referring first to FIGS. 1 and 2, a prior art mounting beam, generally designated 10, is illustrated. Beam 10 has a concave surface 11 having a radius equivalent to the radius of a semiconductor crystal 12. Crystal 12 is mounted to beam 10 using a layer of glue. As is evident from the design, only one type beam 10 may be utilized for a particular diameter crystal. In addition, because of the close match between crystal 12 and beam 10, air pockets can be left in glue between surface 11 and the crystal 12. These air pockets often result in chips in the crystal and/or wafers sliced from the crystal.

To eliminate these problems a mounting beam 20, FIGS. 3–5, was designed. Beam 20 has a surface 21 designed generally in a V-shape. This shape allows any of the various diameters of crystals to be mounted thereon. This is illustrated in FIGS. 4 and 5, where four crystals 23–26 are disposed on V-shaped surface 21 of beam 20. Also shown in FIG. 3 is a plurality of grooves 22 on surface 21. Grooves 22 allow the glue and potential air bubbles to flow when a crystal is disposed on surface 21. This prevents chips that can result from voids caused by air pockets in the glue.

In the prior slicing process, a crystal 12 is mounted on a beam 10 using a glue. This is then indexed into an opening 37 of an inside diameter (ID) blade 30, FIG. 6. As illustrated in FIG. 6, opening 37 is defined by an inner diameter 35 which performs the slicing. About the periphery of blade 30 are a plurality of mounting holes 36. These are used to mount blade 30 to the cutting apparatus. While beam 10 and crystal 12 are held stationary, blade 30 is lowered to slice a wafer from crystal 12. Blade 30 cuts through crystal 12 and partly into beam 10 as illustrated in FIG. 2 by dashed line 13. Blade 30 is then raised and crystal 12 is indexed forward.

Inside diameter 35 of blade 30 is coated with a bead of nickel 31, FIG. 7. Nickel 31 contains pieces of diamond 32 which actually perform the cutting. As shown in FIG. 7, nickel bead 31 is relatively symmetric. After some use, nickel bead 31 will begin to deform, FIG. 8. At this time the slicing process must be halted and crystal 12 removed from the apparatus. A dressing stick is then used to dress nickel 31 of blade 30 back into shape.

A dressing stick is a generally rectangular piece of material that is harder than nickel 31. Two commonly used types of dressing sticks are designated by the numbers 220 and 320. The numbers 220 and 320 relate to the coarseness of the stick with the smaller number being the coarser material. The 220 is the coarser type dressing stick and is made of silicon carbide. The 320 stick is less coarse and is made generally of aluminum oxide.

To dress the blade, a dressing stick is mounted such that one end extends into opening 37 and blade 30 is lowered onto the stick. Once blade 30 is back in alignment, the blade is raised and the dressing stick is removed. Crystal 12 can then be reinserted and the slicing process restarted. This takes a great deal of time to remove crystal 12; dress the blade; and reinsert crystal 12.

To eliminate the delays caused in dressing blade 30, a mounting beam, generally designated 40, FIG. 9, was designed. Mounting beam 40 is a modification of beam 20, FIG. 4, and will have like elements designated by like numbers. Beam 40 has a body 20 with a V-shaped surface 21. Located in body 20 adjacent V-shaped surface 21 are grooves 22. In the base of body 20 are a plurality of dressing sticks 41 and 42. As shown, a dressing stick is placed periodically throughout body 20. The two different types of dressing sticks represent 320 grade (41) and 220 grade (42).

While operating in the normal slicing mode, blade 30 will slice through a semiconductor crystal and into beam 40. While slicing beam 40 the blade 30 will periodically contact dressing sticks 41 or 42. This will dress blade 30 without the need to remove beam 40, thereby eliminating the need for the separate dressing process.

As an alternative to the above, a slicon carbide material is added to the graphite from which the mounting beams are produced. This makes the entire mounting beam a 1200 grit dressing stick. In this way, blade 30 receives a light dressing each time it makes a slice. This eliminates the need for machining grooves in mounting beam 20 to insert dressing sticks 41 and 42.

Thus, it will be apparent to one skilled in the art that there has been provided in accordance with the invention, a device and method that fully satisfies the objects, aims, and advantages set forth above.

While the invention has been described in conjunction with specific embodiments thereof, it is evident that many alterations, modifications, and variations will be apparent to those skilled in the art in light of the foregoing description. Accordingly, it is intended to embrace all such alterations, modifications, and variations in the appended claims.

I claim:

1. A method of slicing a semiconductor crystal comprising the steps of:

providing a mounting beam comprising a first portion and a second portion, a surface of said first portion having a V-shape and a plurality of grooves therein, said second portion being coupled to said first portion and defining an opening therein, and dressing means for dressing a blade, said dressing means being disposed in the opening defined by said second portion;

bonding said semiconductor crystal onto said V-shaphed first surface of said mounting beam adjacent said grooves whereby said grooves prevent the formation of voids in the material used to bond said crystal to said first surface;

inserting said semiconductor crystal and said mounting beams into a slicing apparatus;

slicing said semiconductor crystal with a blade of said slicing apparatus;

slicing said first portion of said mounting beam;

slicing said second portion of said mounting beam; and dressing said blade by slicing said dressing means disposed in the opening of said second portion of said mounting beam.

* * * * *